US006468032B2

(12) United States Patent
Patel

(10) Patent No.: US 6,468,032 B2
(45) Date of Patent: Oct. 22, 2002

(54) FURTHER COOLING OF PRE-SWIRL FLOW ENTERING COOLED ROTOR AEROFOILS

(75) Inventor: Kiritkumar Patel, Oakville (CA)

(73) Assignee: Pratt & Whitney Canada Corp., Quebec (CA)

( * ) Notice: Subject to any disclaimer, the term of this patent is extended or adjusted under 35 U.S.C. 154(b) by 6 days.

(21) Appl. No.: 09/737,600

(22) Filed: Dec. 18, 2000

(65) Prior Publication Data

US 2002/0076318 A1 Jun. 20, 2002

(51) Int. Cl.[7] ..... F01W 5/18
(52) U.S. Cl. ..... 415/115; 415/97 R
(58) Field of Search ..... 415/115, 116, 415/117, 180; 416/95, 96 R, 97 R

(56) References Cited

U.S. PATENT DOCUMENTS 3,565,545 A * 2/1971 Bobo et al. ..... 415/115
3,814,539 A 6/1974 Klompas
4,217,755 A 8/1980 Williams
4,236,869 A * 12/1980 Laurello ..... 415/115
4,541,774 A * 9/1985 Rieck et al. ..... 415/115
4,657,482 A 4/1987 Neal
4,708,588 A 11/1987 Schwarz et al.
5,399,065 A 3/1995 Kudo et al.
5,645,397 A 7/1997 Soechting et al.
5,997,244 A * 12/1999 Gebre-Giorgis et al. .... 415/115
6,183,193 B1 * 2/2001 Glasspoole et al. ..... 415/115

* cited by examiner

*Primary Examiner*—Edward K. Look
*Assistant Examiner*—Igor Kershteyn
(74) *Attorney, Agent, or Firm*—Bachman & LaPointe, P.C.

(57) ABSTRACT

A tangential on board injector with auxiliary supply of further cooled compressed air, from an external heat exchanger or air cooled bearing gallery for example, serves to reduce the volume of cooling air directed tangentially toward a cooled rotor of a gas turbine engine. The tangential on board injector has an array of injector blades between two injector walls defining circumferential main flow nozzles for directing a main compressed air flow tangentially. Each blade has an interior chamber in flow communication with a source of auxiliary compressed air with at least one bore extending between the chamber and an exterior surface of the blade. The bores eject further cooled air from the heat exchanger and merge with the primary compressed air flowing through the injector nozzles. The bores may also produce a cooling film of air that reduces drag over the injector blades. Advantages of the further cooling bores include: reduction in injector air temperature and corresponding reduction in cooling air flow requirements; added control over injector flow volume and temperature to fine tune the delivery of cooling air to the rotor blades; improved cooling air control results in extended durability and service life of air cooled rotor blades; and the ejection of air near the trailing edge of the injector blades results in less drag and air pressure requirements.

5 Claims, 4 Drawing Sheets

FURTHER COOLING OF PRE-SWIRL FLOW ENTERING COOLED ROTOR AEROFOILS

TECHNICAL FIELD

The invention relates to a tangential on board injector with an auxiliary supply of further cooled compressed air, from an external heat exchanger or air cooled bearing gallery for example, that serves to reduce the flow quantity requirements for cooling air to cool a rotor and blades in a gas turbine engine.

BACKGROUND OF THE ART

The invention is applicable to gas turbine engine cooling systems and in particular an improved supply arrangement for cooling air flow to regulate the operating temperature of the turbine blades.

It is widely recognised that the efficiency and energy output of a gas turbine engine can be increased by increasing the operating temperature of the turbine. Under elevated operating temperatures, gas turbine engine components such as the turbine rotors and blades are cooled by a flow of compressed air discharged at a relatively cool temperature. The flow of coolant across the turbine rotor and through the interior of the blades removes heat so as to prevent excessive reduction of the mechanical strength properties of the blades and rotor.

Therefore on the one hand the turbine operating temperature, efficiency and output of the engine are limited by the high temperature capabilities of the various turbine elements and the materials of which they are made. In general the lower the temperature of the elements the higher strength and resistance to operating stresses. On the other hand the performance of the gas turbine engine is very sensitive to the amount of air flow that is used for cooling the hot turbine components. The less air that is used for cooling functions the better the efficiency and performance of the engine.

To cool the turbine rotor blades, a flow of cooling air is typically introduced at a low radius as close as possible to the engine centreline axis. The cooling flow is introduced with a swirl or tangential velocity component through use of a tangential on board injector (TOBI) with nozzles directed at the rotating hub of the turbine rotor.

The effectiveness of cooling air flow is enhanced if the temperature of the cooling air flow is reduced in comparison to the gas path temperature. Cooling air flow is generally derived directly from the output of the compressor without additional processing. The temperature of air increases as it is compressed, however, the compressed air remains below the temperature of the air within the combustor and turbine gas path resulting in the capacity to cool the turbine rotor and turbine blades.

Of course, the lower the temperature of the cooling air flow, the less flow amount that is required for the same cooling effect. Most prior art gas turbine engine systems, however, accept the practical limitation of cooling air at the temperature at which it is delivered from the compressor. Designers merely increase the flow amount of the compressed air to increase the cooling of the turbine components.

The tangential on board injector intakes compressed air from the compressor and delivers the air directed towards rotating rotor hub components with a swirl or tangential velocity component. As the cooling air flow passes over a rotating turbine hub, the air flow temperature rises due to the pumping of the flow from the low injection radius near the engine centreline to the high radius at the turbine blade entry area. In effect the rotating turbine hub acts as an impeller and pumps the air from the injection radius close to the engine centreline. As air is forced radially outward by the rotation of the turbine, the temperature rises as a result of the compression of air during radial pumping as well as the absorption of heat from proximity to the rotor.

By introducing air flow from the tangential on board injector at a swirl or tangential velocity, the temperature rise in the cooling air flow caused by the pumping phenomenon is reduced. In order to introduce a swirl in the air flow from the tangential on board injector, a radial injector conventionally includes an array of injector blades spanning between a forward injector wall and a rearward injector wall to define main-flow nozzles disposed in a circumferential array for directing a main compressed air flow tangentially radially inwardly. Therefore in the tangential on board injector, compressed air is re-directed by the injector blades through TOBI nozzles to direct air with a swirl or tangential velocity component towards rotating turbine rotor components which are to be cooled. The tangential velocity of the injected air flow is generally greater than the rotational velocity of the turbine rotor in order to enable efficient movement of the cooling air flow relative to the rotating rotor.

In the prior art the temperature of the compressed air available for cooling functions is not variable or under the direct control of the designer. Compressed air is delivered from the compressor at a given temperature that is lower than the gas path temperature and therefore may be used for cooling. In order to control the cooling capacity of this compressed air flow, designers increase or decrease the volume of air flow but in the prior art have not to date adjusted the temperature.

In the prior art however, in order to remove heat from the bearings supporting the rotating shafts of an engine, an external heat exchanger is used to deliver cooling air to the bearing gallery. The relatively small amounts of cooling air delivered to the bearings by an external heat exchanger can be carefully controlled and introduced to the bearing gallery at a wide range of selected temperatures. To-date however, the prior art does not include any external heat exchanger input to the air flow conducted over rotor turbines and blades.

It is an object of the invention to provide greater control over the amount and temperature of cooling air flow delivered by a tangential on board injector to turbine rotors and blades.

It is a further object of the invention to adapt the heat exchanger derived cooling air directed to bearing galleries to improve the control and delivery of cooling air from a tangential on board injector system.

It is a further object of the invention to provide a tangential on board injector with reduced drag due to ejection of auxiliary air by the injector blades.

Further objects of the invention will be apparent from review of the disclosure, drawings and description of the invention below.

DISCLOSURE OF THE INVENTION

A tangential on board injector with auxiliary supply of further cooled compressed air, from an external heat exchanger or air cooled bearing gallery for example, serves to reduce the volume of cooling air directed tangentially toward a cooled rotor of a gas turbine engine.

The tangential on board injector has an array of injector blades between two injector walls defining circumferential main flow nozzles for directing a main compressed air flow tangentially radially inwardly. The invention is equally applicable to radial and axial TOBI configurations since each includes injector blades.

Each blade has an interior chamber in flow communication with a source of auxiliary compressed air with at least one bore extending between the chamber and an exterior surface of the blade. The bores eject further cooled air from the heat exchanger and merge with the primary compressed air flowing through the injector nozzles. The bores may also produce a cooling film of air that reduces drag of the injector blades.

The introduction of relatively cooler compressed air ejected through the hollow TOBI blades and cooling bores results in several advantages. The auxiliary air supply from an external heat exchanger adds only marginal cost to the engine since many conventional engines include cooling air supply to the bearing gallery adjacent the TOBI. By merely extending the cooling air supply conduit from the bearing gallery to the TOBI blade area, and increasing the volume of air flow marginally, further cooling air can be supplied to the TOBI at very little cost.

The advantages include a controllable reduction in the tangential on board injector cooling air temperature and a corresponding reduction in the amount of cooling air flow required. The auxiliary supply of cooled air from a heat exchanger adds a significant degree of control over injector flow amount and temperature that enables fine tuning of the delivery of cooling air to the rotor blades. For example, the heat exchanger can be configured to deliver additional cooling air at a predetermined temperature and flow amount. As a consequence of the improved control over delivery of cooling air the durability and service life of air cooled rotor blades is enhanced. When multiple bores are used to deliver additional cooling air, an air film is created by the ejected air over the injector blades especially in the area of trailing edges resulting in reduced drag losses through the TOBI and reduced demand on the compressor.

Further advantages of the invention will be apparent from the following detailed description and accompanying drawings.

DESCRIPTION OF THE DRAWING

In order that the invention may be readily understood, one embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 1:
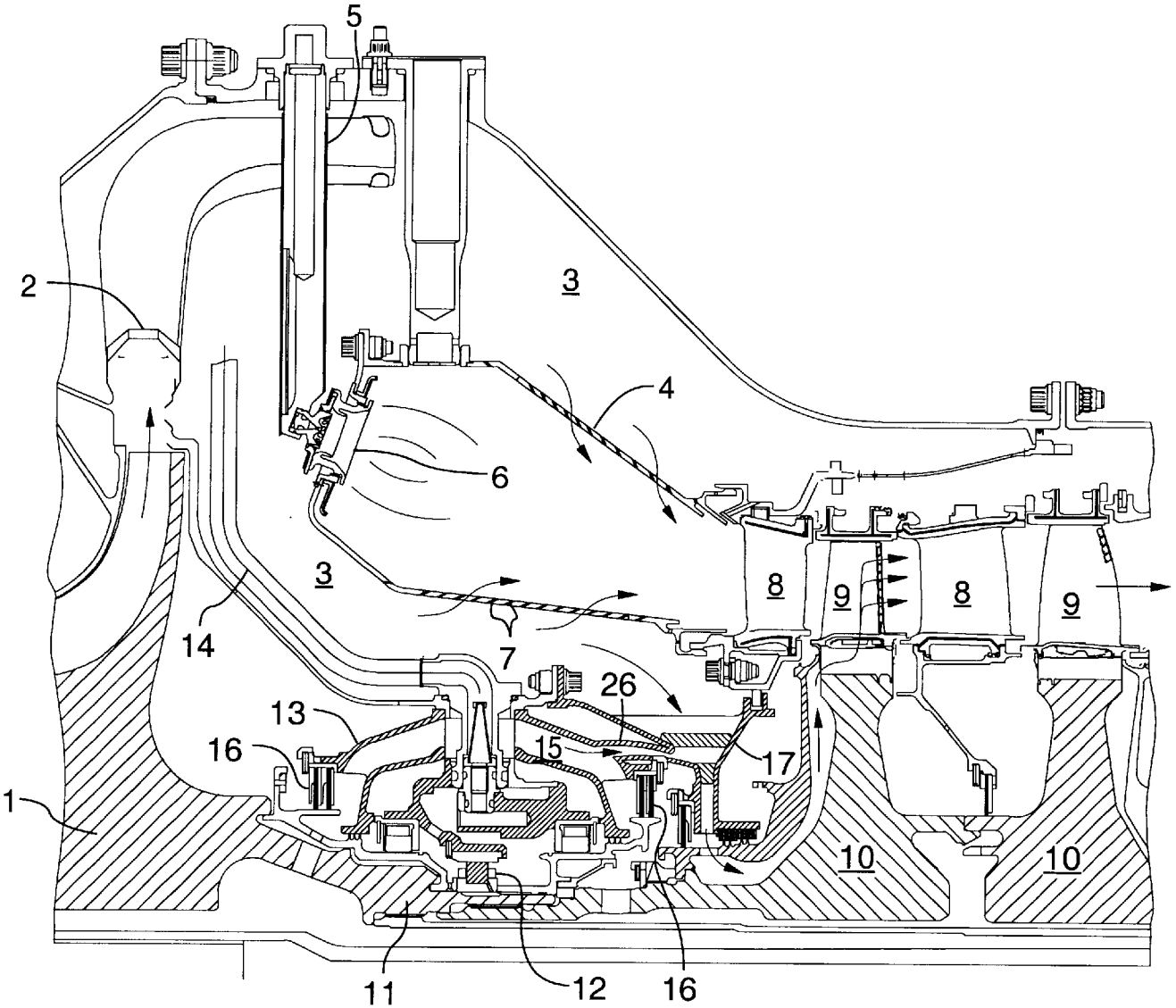
FIG. 1 is an axial cross-sectional view through the combustor and high-pressure turbine section of a gas turbine engine in accordance with the invention.

FIG. 1 illustrates an axial cross-section through the relevant components of a gas turbine engine. In the embodiment illustrated in FIG. 1, a centrifugal compressor impeller 1 delivers compressed air via a diffuser 2 to a plenum 3 surrounding the combustor 4. Fuel is delivered to the combustor 4 via a fuel tube 5 to a fuel spray nozzle 6. Through a series of inlets 7 compressed air from the plenum 3 enters into the interior of the combustor 4, is mixed and ignited with the fuel from the nozzle 6.

The hot gases created within the combustor 4 are directed past an array of stator blades 8 and past the rotor blades 9 mounted to rotor hubs 10 thereby rotating the centrifugal impeller 1. To support the shaft 11 on which the rotors 10 and impeller 1 are mounted, a roller bearing 12 is housed within a bearing gallery 13.

The innermost chamber of the gallery 13 is supplied with lubricating oil via an oil supply conduit 14 and oil is removed via a scavenge conduit (not shown). An outer most chamber 15 of the gallery 13 is ventilated with cooling compressed air and sealed with seals 16. Compressed cooling air delivered to the air chamber 15 of the bearing gallery 13 is provided through an air supply conduit (not shown) communicating between the air chamber 15 and an external heat exchanger (not shown).

Therefore the compressed air housed within the plenum 3 is delivered at the temperature and pressure provided at the exit surface of the impeller 1 through the diffuser 2. On the other hand the compressed air within the cooled chamber 15 of the bearing gallery 13 is provided at a lower temperature from an external heat exchanger and is separated from the plenum 3 with the outer most wall of the gallery 13 and the seals 16.

Figure 2:
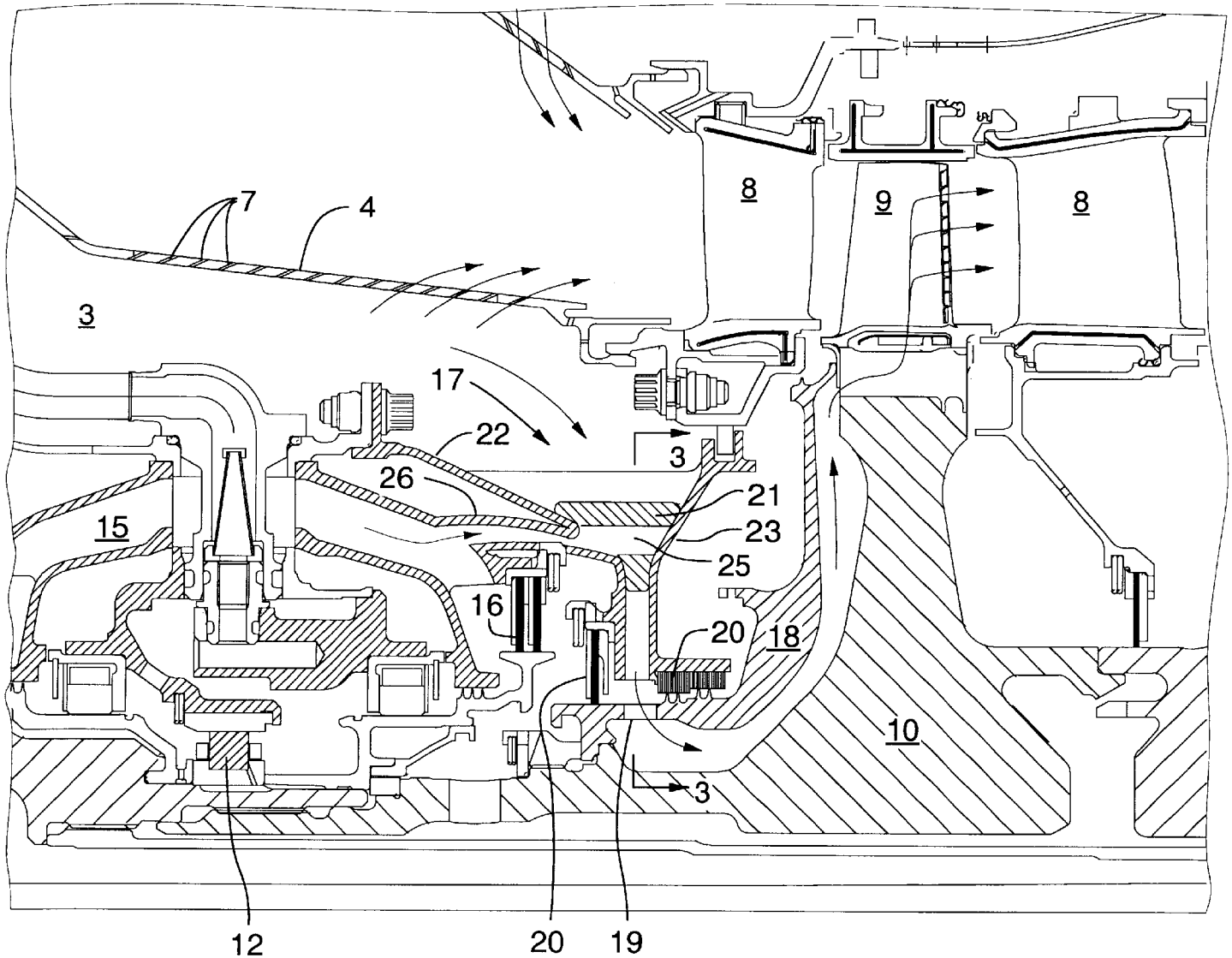
FIG. 2 is an axial cross-sectional view showing details of the radial Tangential On Board Injector (TOBI) adjacent bearing gallery, and HP turbine rotor.
Figure 3:
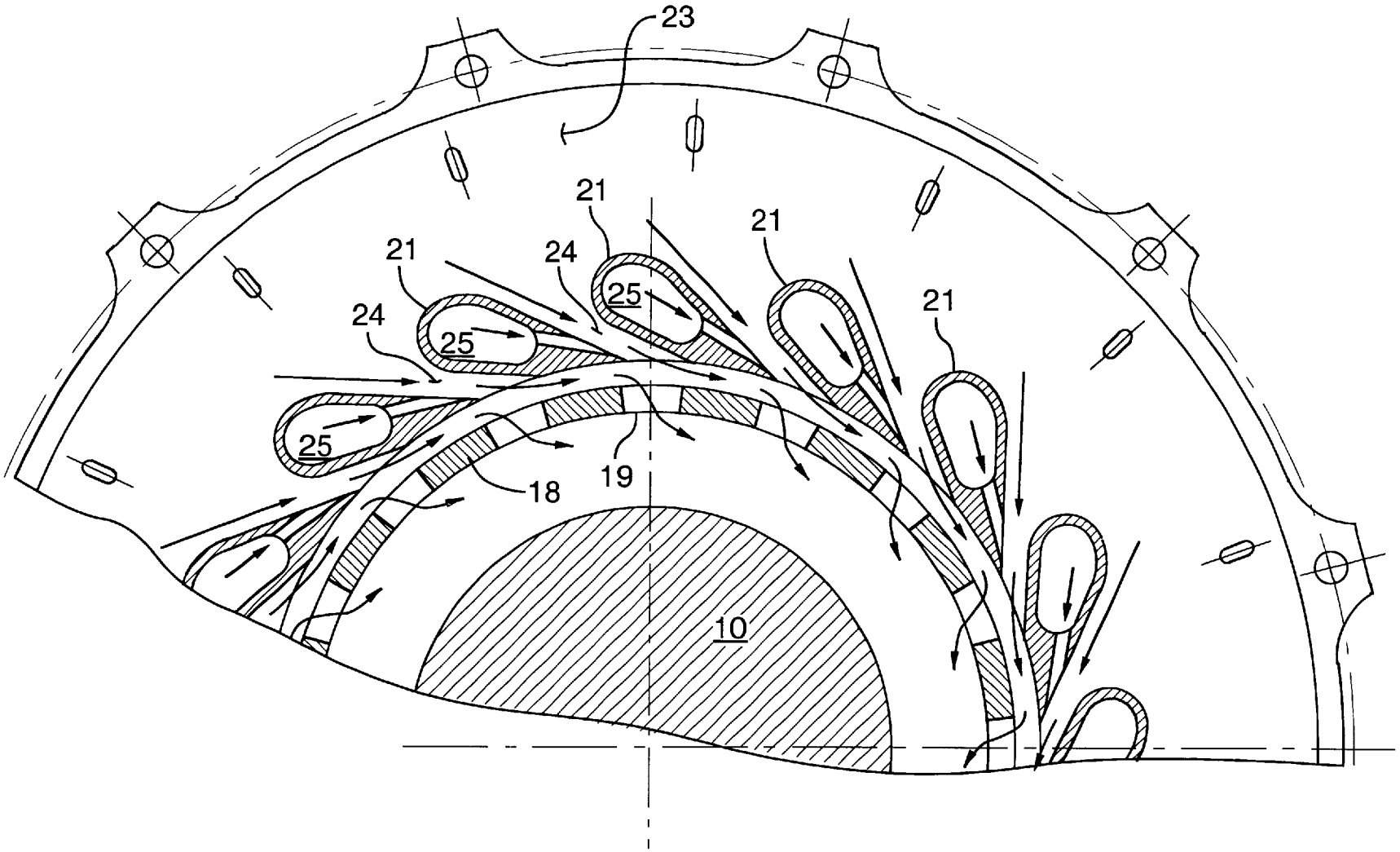
FIG. 3 is a partial radial cross-section view through the blades of the injector (TOBI) along line 3—3 of FIG. 2.

Referring to FIGS. 2 and 3 simultaneously, the conducting of air from the plenum 3 to cool the rotor hub 10 and rotor blades 9 will be described. As shown in FIG. 3 compressed air within the plenum 3 passes through the series of air inlets 7 into the interior of the combustor 4. Compressed air also passes from the plenum 3 into the tangential on board injector 17.

As indicated by the arrows in FIGS. 2 and 3, the injector 17 conveys compressed cooling air from the plenum 3 through a perforated cover plate 18 toward the cooled rotor hub 10. Openings 19 in the cover plate 18 provide access for air directed from the injector 17 to pass between the cover 18 and rotor hub 10 radially outwardly toward the blades 9. As indicated in FIG. 2, the air flow enters beneath the platforms of the blades 9 and is conducted by internal passageways through the blade 9 to exit the trailing edge of the blade 9 into the hot gas path in a known manner.

As indicated in FIG. 2, seals 20 on both sides of the inward portion of the injector 17 contain the compressed air flow between the stationary injector 17 and rotating cover plate 18 to direct the air in a tangential orientation through the openings 19 as indicated in FIG. 3.

The radial tangential on board injector 17 includes a circumferentially spaced apart array of injector blades 21 between a forward injector wall 22 and a rearward injector wall 23 thereby defining tangentially directed main flow nozzles 24 that direct the main compressed air flow tangentially radially inwardly as illustrated in FIG. 3. The invention is equally applicable to an axial TOBI arrangement where blades are disposed between outer and inner walls (not shown).

Figure 4:
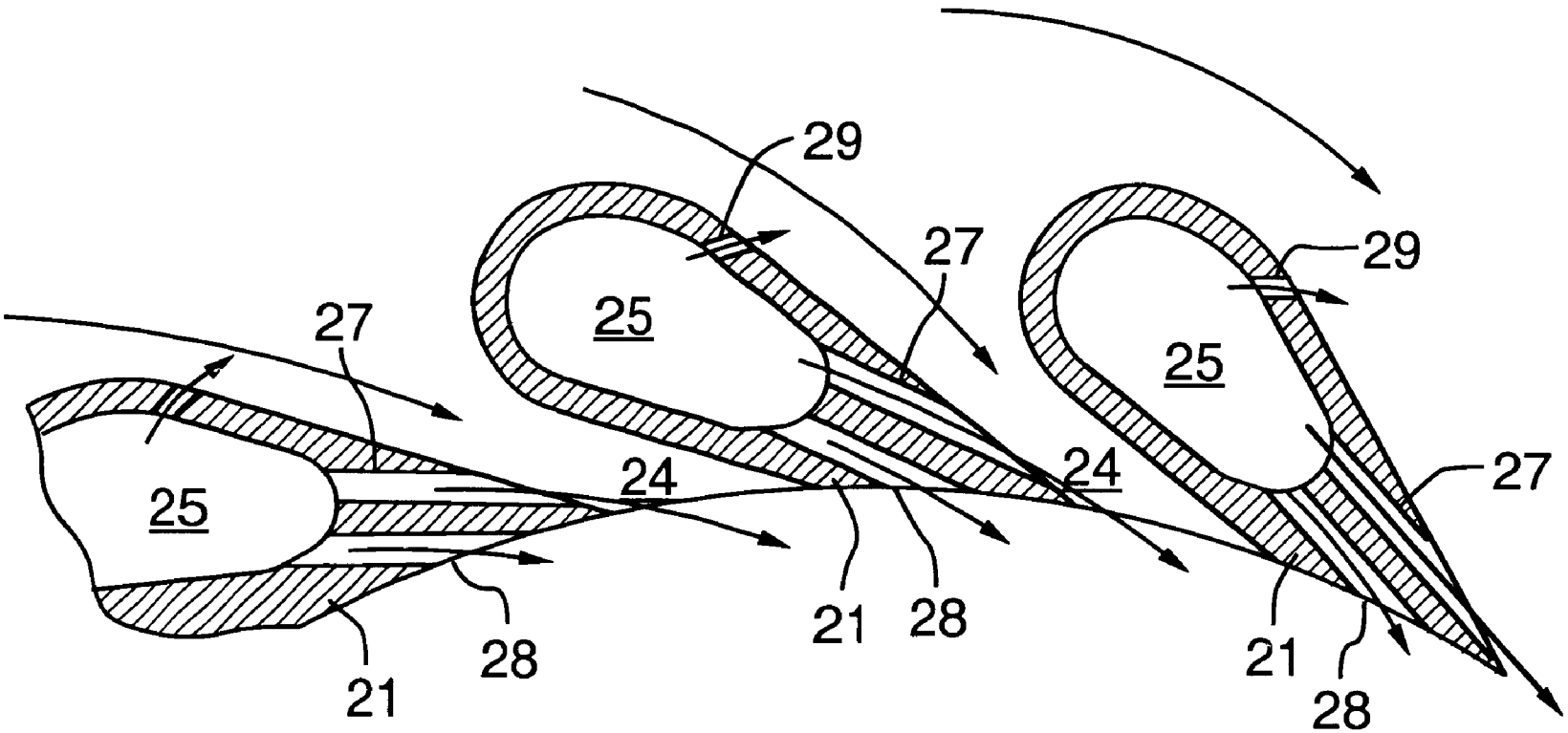
FIG. 4 is a detail radial cross-sectional view showing details of the main injector air flow over the blades, and the auxiliary cooled air flow ejected through the interior chamber of the blades through bores to the exterior surfaces of the blades, forming a surface air film and mixing with the main air flow directed tangentially radially inwardly.

As best indicated in FIG. 4, the blades 21 are hollow and include an interior chamber 25 which is connected to the air chamber 15 of bearing gallery 13 with conduit 26. In this manner the relatively cooler air supplied to the bearing gallery air chamber 15 can be conducted laterally through the conduit 26 to the interior chamber 25 of each blade 21. Minimal cost increase and air flow demand from the heat exchanger results.

As shown in FIG. 4, the auxiliary compressed air from the air cooled engine bearing gallery 13 and the external heat exchanger (not shown) pressurises the interior chamber 25 with relatively cool air which is conveyed through bores 27, and 29 that extend between the chamber 25 and the exterior surfaces of the blade 21.

As indicated in FIG. 4, in the preferred embodiment a merging flow bore 27 carries the majority of the compressed air from the chamber 25 through a suction surface of the blade 21 adjacent to the trailing edge of the blade 21. In order to further mix the flow of air from the chamber 25 with the main flow of air conducted through the nozzle 24, additional air flow bores 28 are provided near the trailing edge of the blade 21. Suction flow bores 29 provide for additional air flow and mixing.

Therefore relatively low temperature air is introduced in the hollow blades 21 and merges with the direction of main air flow through the injector nozzles 24 as close as practically possible. The air flow of different temperatures directed radially inward tend to mix rapidly as they pass through the rotating geometry of the cover plate 18 through openings 19. The mixing is thus achieved without excessive pressure loss and the mixed air is pumped for delivery between the cover plate 18 and rotor hub 10 toward the blade feed system at the periphery of the rotor hub 10.

The addition of cooler air through the bores 27, 28, 29 and centre chamber 25 introduces cooler air from the heat exchanger to mix with the air delivered from the compressor 1 to the plenum 3 surrounding the hot combustor 4. As a result, the volume and temperature of air delivered through the TOBI nozzles 24 is accurately controlled.

Although the above description relates to a specific preferred embodiment as presently contemplated by the inventor, it will be understood that the invention in its broad aspect includes mechanical and functional equivalents of the elements described herein.

I claim:

1. A tangential on board injector for conveying compressed cooling air tangentially toward a cooled rotor of a gas turbine engine, the tangential on board injector comprising: a plurality of injector blades between two injector walls thereby defining main flow nozzles disposed in a circumferential-array for directing a main compressed air flow tangentially, wherein the improvement comprises:

an interior chamber in each blade in flow communication with a source of auxiliary compressed air, a bore extending between the chamber and an exterior surface of the blade.

2. A tangential on board injector according to claim 1 wherein each blade includes:

a merging flow bore in a suction surface of the blade.

3. A tangential on board injector according to claim 1 wherein each blade includes:

a merging flow bore adjacent a trailing edge surface of the blade.

4. A tangential on board injector according to claim 1 wherein the source of auxiliary compressed air comprises a heat exchanger.

5. A tangential on board injector according to claim 1 wherein the source of auxiliary compressed air comprises a conduit in flow communication with an air cooled engine bearing gallery.

* * * * *